US007350724B2

(12) United States Patent
Noelle et al.

(10) Patent No.: US 7,350,724 B2
(45) Date of Patent: Apr. 1, 2008

(54) DOUBLE-SEAL JET SPRAY DEVICE

(75) Inventors: Frédéric Noelle, Montbonnot (FR); Christian Decolin, Montbonnot (FR)

(73) Assignee: Rieter Perfojet, Montbonnot (FR)

( * ) Notice: Subject to any disclaimer, the term of this patent is extended or adjusted under 35 U.S.C. 154(b) by 649 days.

(21) Appl. No.: 10/521,523

(22) PCT Filed: Oct. 7, 2003

(86) PCT No.: PCT/FR03/02939

§ 371 (c)(1),
(2), (4) Date: Jan. 18, 2005

(87) PCT Pub. No.: WO2004/038079

PCT Pub. Date: May 6, 2004

(65) Prior Publication Data

US 2006/0071093 A1 Apr. 6, 2006

(30) Foreign Application Priority Data

Oct. 22, 2002 (FR) ..... 02 13152

(51) Int. Cl.
*B05B 1/14* (2006.01)

(52) U.S. Cl. ..... 239/553; 239/67; 239/552; 239/553.5; 239/566; 239/568; 239/575; 239/600; 28/104; 28/105

(58) Field of Classification Search ..... 239/67, 239/552, 553–553.5, 575, 580, 566–568, 239/590–590.5, 596, 600; 28/104, 105, 167
See application file for complete search history.

(56) References Cited

U.S. PATENT DOCUMENTS

| | | | | |
|---|---|---|---|---|
| 2,949,239 | A * | 8/1960 | Goyette | 239/566 |
| 3,613,999 | A * | 10/1971 | Bentley et al. | 239/553.3 |
| 4,880,168 | A * | 11/1989 | Randall et al. | 239/553.5 |
| 5,042,722 | A | 8/1991 | Randall, Jr. et al. | |
| 5,692,278 | A * | 12/1997 | Fleissner | 28/105 |
| 5,778,501 | A * | 7/1998 | You | 28/104 |
| 6,012,654 | A * | 1/2000 | Fleissner | 239/553.5 |
| 6,474,571 | B2 * | 11/2002 | Schmit et al. | 239/553.3 |
| 6,810,565 | B2 | 11/2004 | Fleissner | |
| 2002/0134866 | A1 | 9/2002 | Schmit et al. | |

FOREIGN PATENT DOCUMENTS

| | | |
|---|---|---|
| DE | 101 12 446 A1 | 8/2002 |
| WO | WO 96/09426 | 3/1996 |

* cited by examiner

*Primary Examiner*—Steven J. Ganey
(74) *Attorney, Agent, or Firm*—Pearne & Gordon LLP

(57) ABSTRACT

The invention concerns a water spraying device comprising a filter and a perforated plate which can be removed by being slid respectively through an opening or a hole emerging into a well provided in the body. A pin being inserted in the well to maintain two plugs of the opening and of the holes when the pin is entirely inserted in the well.

6 Claims, 1 Drawing Sheet

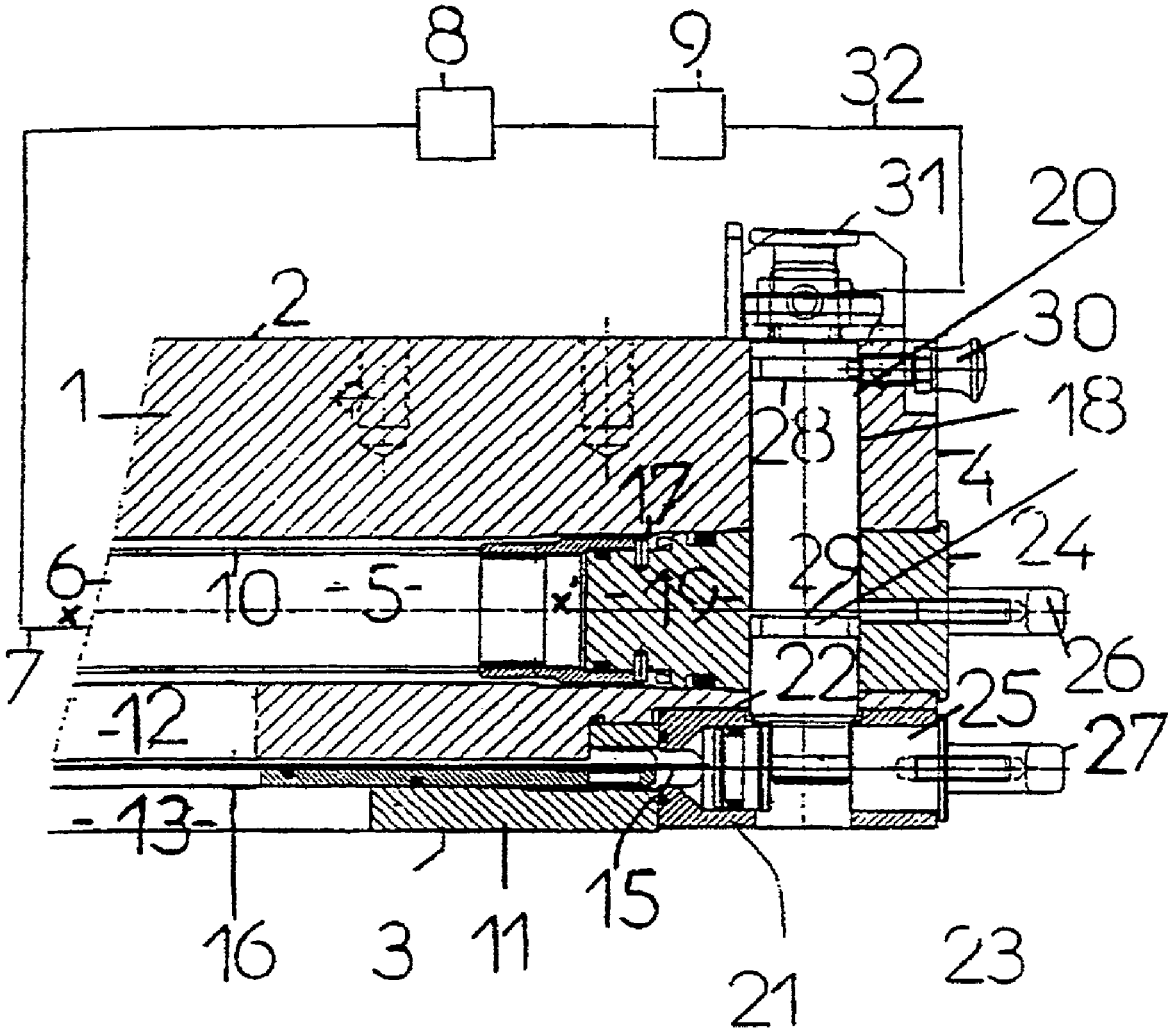
8
9
32
31
20
30
2
1
18
28
4
17
24
6
10
5
29
7
26
22
25
12
27
13
15
16
3
11
21
23

DOUBLE-SEAL JET SPRAY DEVICE

The present invention relates to water jet spray devices which are particularly useful for the water-jet bonding of fibers in nonwovens. This bonding involves sending a curtain of pressurized water jets onto a web of fibers in order to entangle them and form them into a coherent web without the need to use binders or resins. Sheet material such as textile complexes, yarns, paper, wovens and knits can also be bound.

A water jet spray device comprising a body delimiting a chamber for housing a filter is already known. The chamber opens, through an interposed perforated plate creating the jets of suitable diameter, onto a main face of the body and, via an opening which can be sealed by a first removable stopper, toward a front face of the body. The perforated plate is slidably mounted in a housing which opens, via a hole which can be sealed by a second stopper, toward the front face of the body.

The invention aims to simplify the manufacture of a water jet spray device of this kind and also to make it easier to replace the perforated plate and the filter when they both need to be replaced or to replace only the perforated plate.

This is achieved according to the invention through the fact that the opening and the hole open into a common well formed in the body and provided with a complementary opening and with a complementary hole facing the opening and the hole respectively, and a pin is inserted removably into the well through bores made in the stoppers so as to retain the two stoppers therein in the sealing position when it is fully inserted therein.

Since the well is formed in the body, the manufacturing operation dispenses with an attached additional part having to be screwed on. The perforated plate can be replaced by sliding the pin parallel to its longitudinal axis so that it leaves the bore formed in the second stopper while remaining in the bore formed in the first stopper, with the result that the stopper intended for the chamber for housing the filter remains in place. If, nevertheless, it is desired to replace the filter as well, the pin is further withdrawn. The walls of the single well retain a single pin which retains the two stoppers. The stoppers are withdrawn by removing them from the opening and the complementary opening and from the hole and the complementary hole respectively.

According to a single embodiment, first means lock the pin in the position in which it retains the two stoppers in the sealing position and second means lock the pin in an intermediate position in which it retains the first stopper in the position for sealing the opening and stops retaining the second stopper in the position for sealing the hole. The first and the second means consist, for example, of respective peripheral grooves formed on the outer face of the pin and cooperating with a removable finger entering the grooves radially and being able to be operated manually from outside.

In an improvement which affords a high level of safety against accidents to which the operator is exposed by virtue of the high pressures prevailing in the chamber, the pin acts on a control of a device for supplying the chamber with pressurized water by allowing supply only when it is fully inserted into the well. The pin may constitute the operating member of a breaker of an electrical control circuit for the water supply device, or the action of moving it may send a signal to a control unit which controls the water supply device.

The single figure of the appended drawing is a partial sectional view on a scale of ⅓, with the exception of the water supply, of a water jet spray device according to the invention.

The jet spray device according to the invention comprises a parallelepipedal body 1 having two opposite main faces 2, 3, two opposite small faces which do not appear in the drawing and which are arranged in planes parallel to the plane of the drawing, and two opposite front faces 4 of which only the one on the right appears in the drawing. The body is made of steel. An oblong chamber 5 of circular cross section and having an axis X-X' is drilled into the body and passes from one front face 4 to the other. In the front face 4 which is not truly represented in the figure but which is denoted by the sectional chain line 6, there is provided a connection, denoted by the line 7, leading to a pressurized water source 8 which is controlled by a control device 9. A cylindrical filter 10 having the same shape as the chamber 5 but with a smaller diameter is placed in the chamber 5.

The face 3 of the body consists of a clamp 11 which is screwed to the rest of the body 1 by means of screws.

A channel 12, in the form of a slot extending over a generatrix or over two adjacent generatrices of the chamber, leads from the chamber 5 to an opening 13 in the form of a slot formed in the face 3 and opening to the outside.

The clamp 11 delimits a cavity in which there is housed a perforated plate 15 with microperforations having a diameter of between 50 and 500 μm and preferably between 100 and 200 μm, which makes it possible to form water jets or needles. These perforations are arranged in one row or in two rows parallel to the axis X-X' and facing the slot 12.

The perforated plate 15 is slidably mounted, parallel to the axis X'X', in a housing 16 delimited in the body 1.

Toward the front face 4 of the body, the chamber 5 opens, by way of an opening 17, into a bore 18 drilled into the body 1. The opening 17 may be closed off by a first stopper 19 provided with a bore through which a pin 20 entering the bore 18 passes.

In the same way, a second stopper 21 closes off the opening 22 of the housing and comprises a bore through which there also passes an end portion 23 of the pin 20 which is narrower than the rest of the pin 20. Facing the opening 17, a complementary opening 24 of the same size is formed in the body 1, which is situated on the other side of the well and in which the first stopper 29 extends. Facing the hole 22 there is formed a complementary hole 25 in which the second stopper 21 extends. Each stopper is provided on the outside with a grip 26, 27 enabling it to be slid easily parallel to the axis X-X'.

A first peripheral groove 28 and a second peripheral groove 29 are formed on the lateral face of the pin, the groove 29 being closer to the portion 23 than is the groove 28. A finger 30 which can be operated by hand passes through the wall of the well 18 and its end can enter one of the grooves 28 or 29 when the groove is situated facing the finger, and thereby lock the pin in position. When, as represented in the figure, the finger 30 enters the groove 28, the pin is locked such that it retains the first and second stoppers 19 and 21 in a position for sealing the chamber 5 and the housing 16 respectively.

When the pin 20 is raised by withdrawing the finger 30 so as to allow the movement, the groove 29 comes opposite the finger 30. The finger 30 is then pushed back inside the well. The pin is then locked in a second position in which it continues to retain the first stopper 19 but it releases the stopper 21, which can be withdrawn through the complementary hole 25, thus allowing access to the perforated plate 15 in order to replace it.

When, finally, the pin is fully withdrawn from the bore 18, it stops retaining the first plug 19, which can be withdrawn with the possibility of gaining access to the filter 10 and of withdrawing it through the complementary opening 24.

The pin 18 comprises an operating handle 31 making it easier to operate, and there is an electric line 32 leaving therefrom which sends a signal to the control device 9 when the pin 18 is not in the position, represented in the figure, of being fully inserted into the well 18 in which it retains the two stoppers 19 and 21.

The stopper 21 may possibly form part of the body 1 or of the clamp

The invention claimed is:

1. A water jet spray device comprising a body delimiting a chamber for housing a filter, the chamber opening, through an interposed perforated plate, onto a main face of the body and, via an opening which can be sealed by a first removable stopper, toward a front face of the body, the perforated plate being slidably mounted in a housing which opens, via a hole which can be sealed by a second stopper, toward the front face of the body, characterized in that the opening and the hole open into a common well formed in the body and provided with a complementary opening and with a complementary hole facing the opening and the hole respectively, a pin is inserted removably into the well through bores made in the stoppers so as to retain the two stoppers therein in the sealing position when it is fully inserted therein.

2. The device as claimed in claim 1, characterized by first means f or locking the pin in the position in which it retains the two stoppers in the sealing position.

3. The device as claimed in claim 2, characterized by second means for locking the pin in an intermediate position in which it retains the first stopper in the position for sealing the opening and stops retaining the second stopper in the position for sealing the hole.

4. The device as claimed in claim 3, characterized in that the first and second locking means consist of respective peripheral grooves formed on the outer face of the pin and cooperating with a removable finger entering the grooves radially.

5. The device as claimed in claim 4, characterized in that the pin has means for acting on a control of a device for supplying the chamber with water so as to allow supply only when the pin is fully inserted into the well.

6. The device as claimed in claim 1, characterized in that the pin has means for acting on a control of a device for supplying the chamber with water so as to allow supply only when the pin is fully inserted into the well.

* * * * *